United States Patent [19]

Schoeffler

[11] 4,289,210

[45] Sep. 15, 1981

[54] IMPACT DRILL BIT ACTUATOR

[76] Inventor: William H. Schoeffler, P.O. Box 91105, Lafayette, La. 70509

[21] Appl. No.: 125,125

[22] Filed: Feb. 27, 1980

[51] Int. Cl.[3] ..... E21B 1/00; E21B 4/10

[52] U.S. Cl. ..... 175/319; 175/298; 173/123

[58] Field of Search ..... 175/298, 319, 381; 173/123

[56] References Cited

U.S. PATENT DOCUMENTS

| | | | |
|---|---|---|---|
| 1,748,341 | 2/1930 | Grant et al. | 175/381 X |
| 2,072,470 | 3/1937 | Thompson | 175/319 |
| 2,400,853 | 5/1946 | Stilley | 175/381 X |
| 2,673,716 | 3/1954 | Avery | 175/426 X |

*Primary Examiner*—William F. Pate, III
*Attorney, Agent, or Firm*—Bacon & Thomas

[57] ABSTRACT

A rotary drive member such as a drill string, has a housing rotatably mounted at its lower end and an axial-throw cam is fixed at the lower end of the drive member in the housing. Chisel blades are axially slidable in the housing and are reciprocated by the cam in such manner that two dimetrically opposed blades are lifted and then forcibly driven downward while other chisel blades are left in contact with the well bottom to intermittently hold the housing against rotation. The chisel blades are sharpened in such a way that they tend to rotate the housing through a small angle at each downward impact.

10 Claims, 8 Drawing Figures

4
8
6
2
32
12
10
26
36
30
34
14
24
36
28
16
40
38
44
44
46
2
2
54
18
66
20
68
52
42
56
22
58
39
60
48
48
72
72
3
3

58
46
62
66
48
48
8
16
58
58
20
42
39
58
46

46
42
72
70
48
72
48
72
70
70
46

44
42
43
5
72
45
72
44
44
72
40
44
5

IMPACT DRILL BIT ACTUATOR

BACKGROUND OF THE INVENTION

This invention is in the field of drilling bits and particularly bits adapted to be impacted periodically on the formation being drilled.

It has been proposed to provide well drills having drill bits adapted to be periodically impacted against the formation to facilitate drilling. See, for example, the patents to Snyder, U.S. Pat. No. 2,742,685, Stilley, U.S. Pat. No. 2,400,853 and Grant et al, U.S. Pat. No. 1,748,341. The Grant patent lifts drill bits or chisels periodically, then releases them to the action of springs to effect impacting the formation while in Synder a hammer periodically strikes the drill. In Grant and Snyder rotation of the drill string causes relative rotation between cam elements to effect vertical impaction. In the Stilley patent, a turbine, driven by drilling mud, is caused to drive cams to impact the chisels downwardly, although they are lifted by means of springs.

SUMMARY OF THE INVENTION

The present invention comprises an impact arrangement for impacting drill chisel blades periodically and comprises diametrically opposed pairs of chisel blades slidably mounted in a housing rotatably carried by a driving member. The chisel blades are alternately lifted, that is, the blades of diametrically opposed pairs are lifted, while the remaining blades remain in contact with the formation, and thus hold the housing against unrestrained rotation during the drilling process. The driving member carries a double cam arrangement effective to alternately lift and then drive downwardly diametrically opposed pairs of chisel blades. The blades are so sharpened that each impact tends to rotate the housing in the forward direction a slight amount, and thus insure drilling of the entire bottom of the hole. Each chisel is replaceable so that chisels of different dimensions may be used to drill holes of different sizes and each chisel blade has a cutting edge extending downwardly and inwardly. One pair of opposed blades extend completely to the center of the apparatus, whereas the remaining pairs have inner edges slidably abutting the sides of that one pair to insure complete drilling of the hole throughout its transverse area.

DESCRIPTION OF A PREFERRED EMBODIMENT

Figure 1:
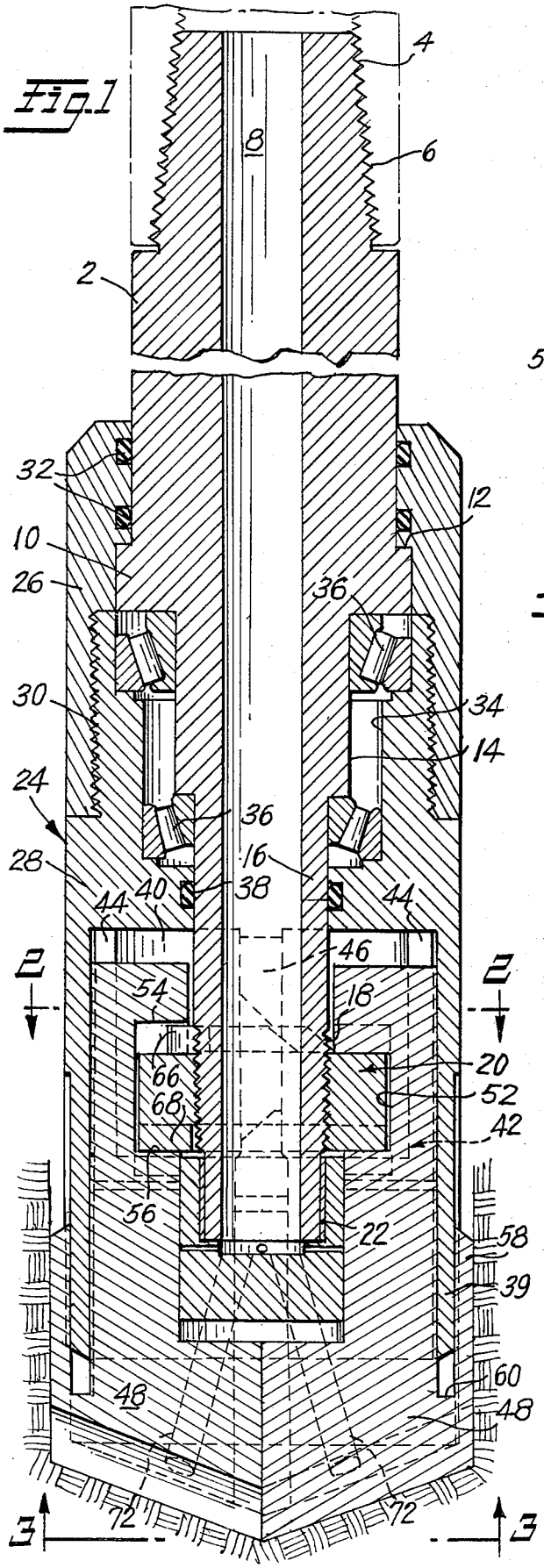
FIG. 1 is a vertical sectional view through the impact drill bit actuator of the present invention.
Figure 2:
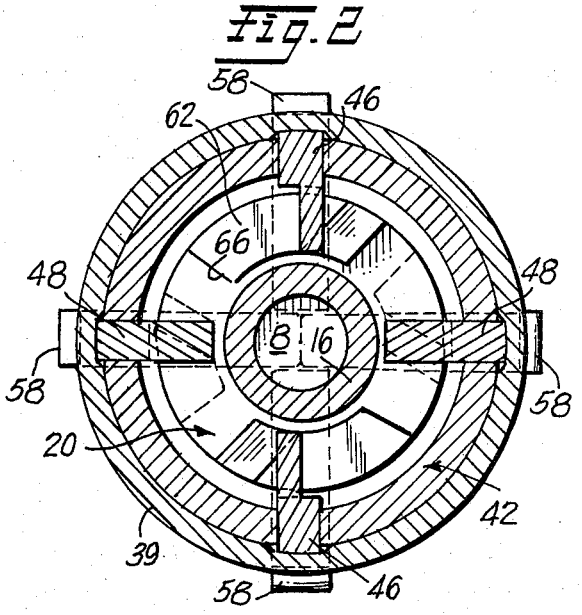
FIG. 2 is a horizontal sectional view, taken on the line 2—2 of FIG. 1.

The drawings illustrate a preferred embodiment of the invention, wherein (FIG. 1) numeral 2 designates a driving member to be attached to the lower end of a conventional drill string 4 by means of the usual tapered threads 6. The driving member 2 has a central bore 8 therethrough for a purpose to be described later, and comprises an upper portion of a diameter substantially equal to that of the drill string 4 and an enlarged ring portion 10 having a shoulder 12.

Below the ring portion 10 is a reduced diameter portion 14 and a lower reduced diameter portion 16. Adjacent its lower end, the portion 16 is provided with threads 18 on which a cam member 20, to be described, is secured. The lowermost end of the portion 16 comprises a pilot extending into a bearing 22 in a plug member which will be described later. Surrounding the driving member 2 is a housing 24 comprising an upper cap portion 26, screw threaded to an intermediate portion 28, at threads 30. The cap portion 26 has an inwardly extending flange-like upper end resting on and abutting the shoulder 12 and provided with O-ring seals 32 embracing and sealing against the driving member 2. The intermediate portion 28 is counterbored at 34 to receive roller or other antifriction bearings 36 by which the housing 24 is rotatably mounted on the driving member 2.

Also, as shown at 38, an O-ring seal is provided between the intermediate portion 28 of the housing 24, and the driving member 2, below the chamber containing the bearings 36. Below the o-ring 38, the housing portion 28 is in the form of a cylindrical skirt 39 to define a chamber 40.

Figure 5:
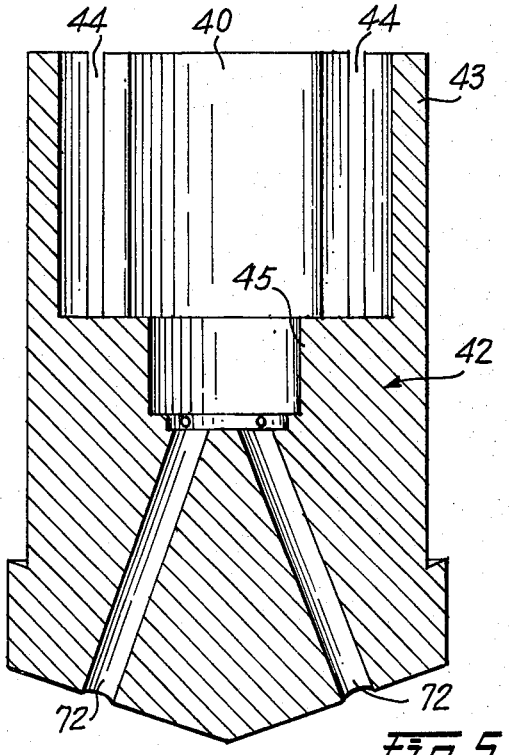
FIG. 5 is a vertical sectional view of the drill actuator housing taken on the line 5—5 of FIG. 4.

The lower end of the housing 24 is closed by a plug member 42 (see also FIG. 5) having a hollow cylindrical upper portion 43 fitted within the skirt portion 39 of the housing 24. A central bore 45 houses pilot bearing 22, previously described.

Figure 4:
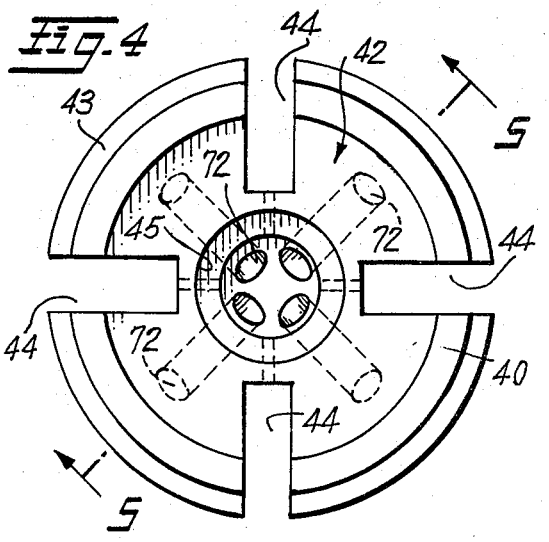
FIG. 4 is a plan view of the drill actuator housing.

As shown most clearly in FIG. 4, the plug member 42 is provided with radial slots 44 adapted to slidably receive diametrically opposed chisel blades 46 and 48.

Figure 3:
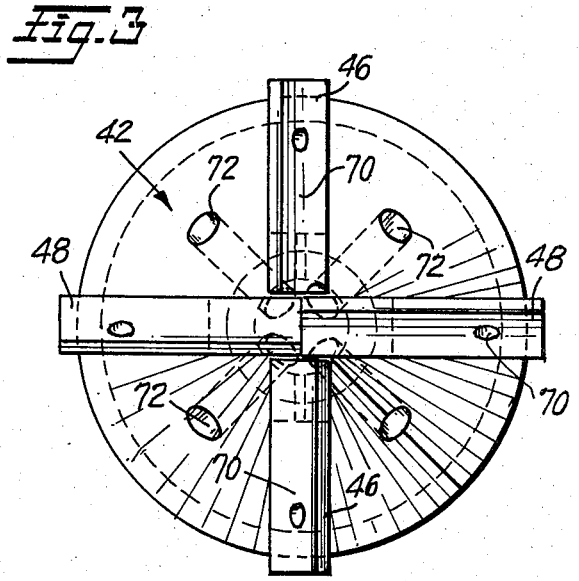
FIG. 3 is a bottom plan view of the drill, taken on the line 3—3 of FIG. 1.
Figure 6:
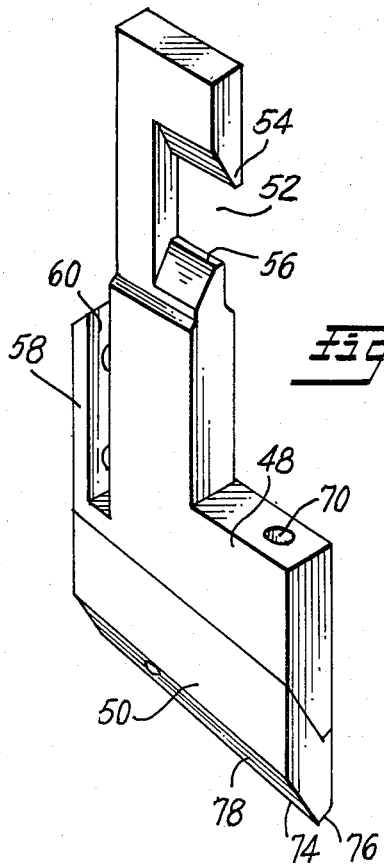
FIG. 6 is an isometric view of one of the drill chisels.

The chisel blades 48 are best shown in FIG. 6, it being understood that chisel blades 46 are of the same configuration, but are of less radial dimension. As most clearly shown in FIG. 3, the chisel blades 48 extend clear to the center of the housing 24 and have inner abutting edges whereas the blades 46 are of lesser radial dimension and extend inwardly only into sliding abutting relation to the side faces of the blades 48 near the center of the apparatus. As also shown in FIG. 6, each of the blades 48 comprises a lower chisel portion 50 and an upper portion provided with a notch 52 adapted to embrace the cam 20. As shown, the notch 52 is bordered by upper and lower cam followers 54 and 56 adapted to engage upper and lower cam elements on cam 20, as will be described later. As is clear from FIG. 1, the edges 74 of the chisel blades slope inwardly and downwardly to the center of the apparatus.

As also shown in FIG. 6, each of the blades 48 is provided with an outer upstanding portion 58 spaced from the main body of the chisel blade, and providing a notch 60 which slidably embraces the lower edge of the skirt portion 39 of the housing 24. Thus, the blades may be replaced by blades having a wider outer portion 58 to drill holes of different selected sizes.

Figure 7:
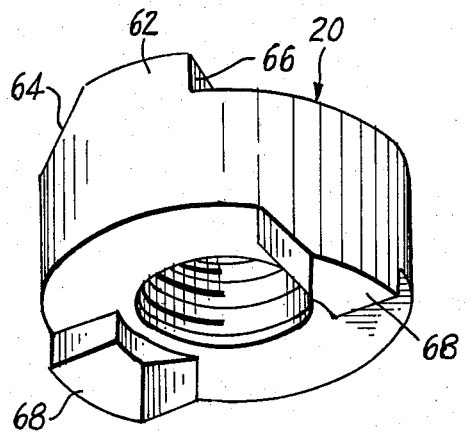
FIG. 7 is a bottom perspective view of the drill actuating cam showing the impact cam surfaces therein.
Figure 8:
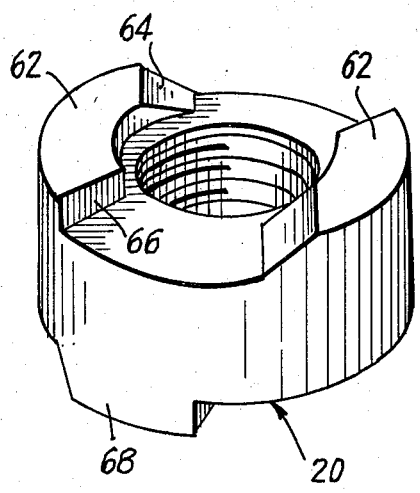
FIG. 8 is a top perspective view of the drill actuating cam showing the lifting cam surfaces thereon.

The cam 20 is best shown in FIGS. 7 and 8, FIG. 7 illustrating the lower face of the cam, and FIG. 8 illustrating the upper face. As clearly shown in the figures, the cam 20 is provided with upper camming portions 62, each having a riser ramp 64 and a drop-off shoulder 66. As clearly shown in these figures, two camming members or elements 62 are diametrically opposed on the upper face of the cam body 20. An identical pair of camming elements 68 is provided on the lower face of the cylindrical cam 20 and are diametrically opposed to each other, but are displaced 90°, about the axis of the cam, from the cam elements 62 on the upper face of the cam body. The lower cam members 68 also have riser and dropoff end portions identical to those of the camming elements 62. The parts are so dimensioned that the width of the notch 52 in each of the chisel blades is substantially equal to the axial thickness of the cam body 20 plus the height of camming elements 62 or 68, and thus the cam, when rotating relative to the housing 24 will alternately lift opposed pairs of chisel blades and then forcibly drive the same downwardly to impact against the formation being drilled.

As previously stated, the driving member 2 is provided with a central bore 8 that extends downwardly to the lower end of the driving member and opens into the chamber above the plug 42, already described. Each of the chisel bits is provided with at least one passageway 70 extending from an upper edge portion to the cutting edge thereof. The upper end of each passageway 70 communicates with the chamber 40 in which the cam 20 is located, and thus drilling mud which is pumped downwardly through the drill string and bore 8 enters a passageway 70 and exits at the cutting edge of each of the chisel blades. In addition, the plug member 42 is provided with passageways 72, also communicating with that chamber and terminating in the lower face of the plug member to further direct dirlling mud onto the formation being drilled.

As also well shown in FIG. 6, the lower or cutting edge of each chisel blade is defined by a knife edge 74 which is formed by a short or narrow beveled surface 76 on one side of the chisel blade and a wider beveled surface 78 extending to the other side of the chisel blade. Thus, the cutting edge 74 is quite close to one of the vertical faces of the blade, and the wider bevel surfaces 78 on all of the chisel blades extend in the same hand around the axis of the apparatus. Thus, as one pair of chisel blades is being lifted, the other pair or pairs remain in contact with the surface of the hole and prevent rotation of the housing 24 while the driving member 2 continues to rotate. At each downward impact caused by the lower camming members 68, the pair of chisel blades being downwardly will forcibly enter the formation, and due to the difference in the bevel surfaces 76 and 78, a slight rotational component will be imparted to the housing 26. It is to be remembered that when one pair of chisel blades is caused to impact the formation at the bottom of the hole, the other pair is being lifted so as to relieve restraint to rotation, and the housing can thus be rotated through a small angle by the impact.

While a single specific embodiment of the invention has been shown and described, the same is merely illustrative of the principles involved and other forms may be employed within the scope of the appended claims.

I claim:

1. A well drilling assembly comprising;

a vertically extending rotatable drive member having a cam fixed to the lower end thereof;

a housing rotatably mounted on the lower end portion of said drive member about said cam;

a plurality of pairs of diametrically opposed and radially extending chisel blades carried by and axially slidable on said housing and having cam follower means thereon;

said cam being configured to sequentially lift said pairs of diametrically opposed chisel blades, one pair at a time, and then forcibly project them downwardly, upon relative rotation between said drive member and housing, while leaving the remaining chisel blades in their lower position;

said cam comprising a cylindrical body concentric to the axis of said drive member and having upper and lower axial end faces; a pair of diametrically opposed camming elements on each of said axial faces.

2. A well drilling assembly as defined in claim 1 wherein each camming element has a riser ramp at its leading end and an abrupt shoulder at its trailing end, the pair of camming elements on one axial face of said cam being angularly displaced from those on the other face such that a chisel blade dropping in one axial direction off the abrupt shoulder of an element on one face is promptly thereafter engaged by a riser ramp of an element on the other face to be forcibly urged further in said one axial direction.

3. A well drilling assembly as defined in claim 2 wherein each of said chisel blades has a notch on an inner edge portion, the notch embracing the periphery of said cam and the upper and lower edges of said notch comprising said cam follower means.

4. A well drilling assembly as defined in claim 1 wherein said housing includes a hollow cylindrical portion defining a chamber;

said chisel blades being axially slidable along the cylindrical wall of said chamber and each having an outer portion slidable along the outer surface of said cylindrical wall; each chisel blade having a knife edge at its lower end extending from its inner edge to its outer edge.

5. A well drilling assembly as defined in claim 4 wherein each of said knife edges extends oblique to the axis of said housing, sloping downwardly and inwardly from their outer ends.

6. A well drilling assembly as defined in claim 1 wherein each of said chisel blades has a knife-edge lower end, each knife edge being defined by oblique bevel surfaces of unequal width, all the widest bevel surfaces extending in the same hand around the axis of said drive member.

7. A well drilling assembly as defined in claim 4 wherein said drive member is a hollow tubular member the interior of which communicates with said chamber for directing drilling mud therethrough.

8. A well drilling assembly as defined in claim 6 including at least one passageway through each chisel bit, each of said passageways communicating at one end with said chamber and opening at its lower end of the lower edge of the chisel blade.

9. A well drilling assembly as defined in claim 1 wherein said housing includes a plug member at the lower portion thereof, said plug member having radial slots therein slidably receiving said chisel blades.

10. A well drilling assembly as defined in claim 1 wherein one pair of said diametrically opposed chisel blades extend radially inwardly to the axial center of said housing and wherein the remaining chisel blades have inner edges slidably abutting the sides of said one pair.

* * * * *